US011591205B2

(12) United States Patent
Bendig et al.

(10) Patent No.: US 11,591,205 B2
(45) Date of Patent: Feb. 28, 2023

(54) TOUCHLESS BEVERAGE DISPENSER VALVE

(71) Applicant: Marmon Foodservice Technologies, Inc., Osseo, MN (US)

(72) Inventors: James Bendig, Naperville, IL (US); E. Scott Sevcik, Crystal Lake, IL (US); David K. Njaastad, Palatine, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 17/313,542

(22) Filed: May 6, 2021

(65) Prior Publication Data

US 2021/0347628 A1 Nov. 11, 2021

Related U.S. Application Data

(60) Provisional application No. 63/021,303, filed on May 7, 2020.

(51) Int. Cl.
*B67D 1/08* (2006.01)
*B67D 1/12* (2006.01)

(52) U.S. Cl.
CPC ..... *B67D 1/0888* (2013.01); *B67D 1/1277* (2013.01)

(58) Field of Classification Search
CPC .. B67D 1/0888; B67D 1/1277; B67D 1/1238; B67D 1/124
See application file for complete search history.

(56) References Cited

U.S. PATENT DOCUMENTS

| | | | | |
|---|---|---|---|---|
| 4,798,232 A * | 1/1989 | Stembridge | B67D 1/1238 141/1 |
| 4,944,336 A * | 7/1990 | Stembridge | B06B 1/0681 141/1 |
| 5,036,892 A * | 8/1991 | Stembridge | B67D 1/1238 141/1 |
| 5,868,311 A | 2/1999 | Cretu-Petra | |
| 6,053,359 A | 4/2000 | Goulet et al. | |
| 6,206,241 B1 * | 3/2001 | Terrell | A47K 5/1204 222/129.2 |

(Continued)

FOREIGN PATENT DOCUMENTS

| | | |
|---|---|---|
| CN | 105264312 B | 6/2018 |
| EP | 1647951 A1 | 4/2006 |

(Continued)

OTHER PUBLICATIONS

International Search Report and Written Opinion for PCT/US2021/035654, dated Sep. 1, 2021.

*Primary Examiner* — Donnell A Long
(74) *Attorney, Agent, or Firm* — Andrus Intellectual Property Law, LLP

(57) ABSTRACT

A touchless beverage dispensing valve assembly includes a nozzle and a valve configured to control a flow of a substance through the valve to the nozzle. A solenoid is configured to operate the valve between open and closed conditions. A trigger sensor includes an optical sensor and a controller. The controller executes a trigger sensor control module to receive an output from the optical sensor and operate the solenoid to control the valve between the open condition and the closed condition. A feedback device is operable to selectively provide a visual indication an operational status of the valve.

17 Claims, 9 Drawing Sheets

(56) References Cited

U.S. PATENT DOCUMENTS

| | | | | |
|---|---|---|---|---|
| 6,354,468 | B1 | 3/2002 | Riek | |
| 6,394,153 | B2 | 5/2002 | Skell et al. | |
| 6,688,134 | B2 | 2/2004 | Barton et al. | |
| 6,789,585 | B1 | 9/2004 | Janke | |
| 7,614,524 | B2 | 11/2009 | Girard et al. | |
| 7,673,661 | B2 | 3/2010 | Chase et al. | |
| 8,109,301 | B1 * | 2/2012 | Denise | G07F 9/023 141/360 |
| 8,490,540 | B2 | 7/2013 | Webster et al. | |
| 8,950,254 | B2 | 2/2015 | Bernhardsgruetter et al. | |
| 9,417,003 | B2 | 8/2016 | Baack | |
| 9,477,317 | B1 | 10/2016 | Clements | |
| 9,840,407 | B2 | 12/2017 | Difatta et al. | |
| 10,053,354 | B2 | 8/2018 | Rosenlund et al. | |
| 10,178,928 | B2 | 1/2019 | Ophardt et al. | |
| 10,235,865 | B2 | 3/2019 | Thyroff | |
| 10,258,191 | B2 | 4/2019 | Apone et al. | |
| 10,269,082 | B2 | 4/2019 | Morris et al. | |
| 10,362,896 | B2 | 7/2019 | Apone et al. | |
| 10,571,041 | B2 | 2/2020 | Bischel | |
| 2003/0071093 | A1 * | 4/2003 | Pinedjian | B67D 1/0084 222/642 |
| 2003/0155031 | A1 | 8/2003 | Barton et al. | |
| 2007/0158359 | A1 * | 7/2007 | Rodrian | A47K 10/3687 222/52 |
| 2008/0282897 | A1 | 11/2008 | Webster et al. | |
| 2009/0178728 | A1 | 7/2009 | Cochran et al. | |
| 2009/0308494 | A1 | 12/2009 | Linn | |
| 2010/0242497 | A1 * | 9/2010 | Bertone | B67D 1/0053 62/1 |
| 2011/0017776 | A1 * | 1/2011 | Metropulos | B67D 1/0888 222/129.1 |
| 2013/0075426 | A1 | 3/2013 | Crane et al. | |
| 2013/0314244 | A1 * | 11/2013 | Hershberger | B67D 1/0888 340/870.02 |
| 2014/0197197 | A1 * | 7/2014 | Kamen | C02F 1/325 222/52 |
| 2016/0207753 | A1 | 7/2016 | Choi et al. | |
| 2016/0368754 | A1 * | 12/2016 | Rosen | B67D 1/0081 |
| 2017/0079468 | A1 | 3/2017 | Apone et al. | |
| 2017/0079469 | A1 | 3/2017 | Apone et al. | |
| 2018/0201492 | A1 | 7/2018 | Jung et al. | |
| 2018/0327243 | A1 | 11/2018 | Rider et al. | |
| 2019/0223654 | A1 | 7/2019 | Apone et al. | |
| 2019/0272042 | A1 * | 9/2019 | Shivam | G06F 3/00 |
| 2020/0000274 | A1 | 1/2020 | Apone et al. | |
| 2020/0031655 | A1 * | 1/2020 | McMahon | G01S 17/88 |
| 2020/0055720 | A1 | 2/2020 | Volftsun et al. | |
| 2020/0087135 | A1 * | 3/2020 | Youn | B01D 35/26 |

FOREIGN PATENT DOCUMENTS

| | | | |
|---|---|---|---|
| EP | 2449929 | A1 | 5/2012 |
| EP | 3172970 | A1 | 5/2017 |
| EP | 3275348 | A1 | 1/2018 |
| EP | 3670436 | A1 | 6/2020 |

* cited by examiner

TOUCHLESS BEVERAGE DISPENSER VALVE

CROSS-REFERENCE TO RELATED APPLICATIONS

The present application claims priority to U.S. Provisional Patent Application No. 63/021,303 filed on May 7, 2020, and which is incorporated by reference herein in its entirety.

FIELD

The present disclosure relates to a touchless beverage valve assembly for ice and beverage dispensing machines.

BACKGROUND

The following U.S. patents provide background information and are incorporated by reference in their entireties.

U.S. Pat. No. 10,077,180 discloses a beverage dispensing head includes a housing having a front, a rear, and a base that extends between the front and the rear. A mixing nozzle is configured to dispense a flow of beverage via the base. A valve is configured to control the flow of beverage via the mixing nozzle, and a switch is movable into and between a closed position in which the valve opens the flow of beverage via the mixing nozzle and an open position in which the valve closes the flow of beverage via the mixing nozzle. A lighting module disposed in the housing is configured to illuminate the front of the housing and the base of the housing when the switch is moved into the closed position.

U.S. Pat. No. 9,840,407 discloses a beverage dispensing system that includes a plurality of beverage sources each containing a beverage component, and at least one flow valve connected to one or more of the beverage sources and operable to control a flow of the beverage component therefrom. The system further includes a graphical display that presents a plurality of available beverages and a gesture capture device that receives a selection gesture input to select a beverage from the plurality of available beverages. A controller is also included that adjusts the at least one flow valve based on the selection gesture input to dispense the selected beverage.

U.S. Pat. No. 6,053,359 discloses an automated system for preparing and delivering postmix beverages in response to one or more drink orders being entered from a remote point of sale unit or a local keypad that includes: a postmix beverage preparation assembly for dispensing ice and a selected postmix beverage into a cup; an oblong carousel type conveyor assembly including a plurality of upwardly open cup holders which are driven by a motor driven belt so as to pass beneath a cup dispensing station, an ice dispensing station, a beverage dispensing station, and a plurality of pick-up stations; a cup storage and dispenser assembly including a bidirectionally rotatable turret upon which is mounted a plurality of different sized cup supply tubes for holding a respective stack of beverage cups; and a pneumatic vertically driven cup gripper/extractor mechanism having a pair of pneumatically operated gripper arms which operate to remove a cup from a selected supply tube on the turret and placing the extracted cup into an empty cup holder which is then transported past the dispensing stations and then to a pick-up station on the conveyor for manual removal by an attendant.

U.S. Patent Application Publication No. 2013/0075426 discloses a beverage dispensing apparatus that includes a dispensing structure, a transportation mechanism linked with the dispensing structure, and a staging structure linked with the transportation structure. A control system is linked with the dispensing structure, the staging structure, and the transportation mechanism. A sensor mechanism is linked with the control system. The sensor mechanism provides signals indicating the position of a cup. A cup identification system having an interactive display is connected to the control system. The display has visual characteristics indicating the position and characteristics of a cup.

BRIEF DISCLOSURE

An example of a touchless beverage dispensing valve assembly includes a nozzle. A valve is coupled upstream of the nozzle. The valve is configured to control a flow of a substance through the valve to the nozzle. A solenoid is operatively connected to the valve and configured to operate the valve between an open condition and a closed condition. A trigger sensor includes an optical sensor and a controller. The controller executes a trigger sensor control module to receive an output from the optical sensor and operate the solenoid to control the valve between an open condition and a closed condition. The substance is dispensed through the nozzle when the nozzle is in the open condition. A feedback device is operable to selectively provide a visual indication of each of: a stand-by condition, a detection of a receptacle beneath the nozzle, and an active dispensing operation.

Further examples of a touchless beverage dispensing valve assembly include the controller configured to operate the feedback device to produce the visual indication based upon a current output of the optical sensor and at least one time since initiation of a current operational state of the valve assembly. The optical sensor may be a photoelectric sensor. The current output of the optical sensor may include a baseline output signal and the controller operates the feedback device to provide the visual indication of the stand-by condition. The controller is configured to operate the feedback device to provide the visual indication of the detection of the receptacle when the current output of the optical sensor deviates from the baseline output signal by a predetermined amount. The controller is configured to operate the feedback device to provide the visual indication of the active dispensing operation when the current output of the optical sensor deviates from the baseline output signal by a predetermined amount for at least 100 ms. The controller is configured to operate the solenoid to operate the valve to the open condition after the feedback device is operated to provide the visual indication of the active dispensing operation. The controller is configured to measure an elapsed time that the valve is in the open condition and the controller is further configured to operate the feedback device to provide a visual indication of the elapsed time. The controller is configured to operate the solenoid to operate the valve to the closed condition upon either a detected change in the current output of the optical sensor towards the baseline output signal or the elapsed time reaching a predetermined time. The controller is configured to receive and store a value representative of the baseline output signal through a calibration process.

Additional examples of a touchless beverage dispensing valve assembly include a trigger sensor housing that surrounds the optical sensor and an optical sensor circuit board, and the optical sensor circuit board is communicatively connected to the optical sensor and produces the output. The trigger sensor housing includes a curved exterior wall, the curved wall configured to fit partially about the nozzle. The valve assembly may further include a tray configured to be positioned about the nozzle and configured to retain the controller and the feedback device, and the trigger sensor housing includes a plurality of retainer clips configured for resilient deformation to retain the trigger sensor housing to the tray. The trigger sensor housing may further include a retainer bar that secures within retainer recesses positioned to interior faces of walls of the trigger sensor housing and the retainer bar is configured to secure the optical sensor and the optical sensor circuit board within the trigger sensor housing.

In still further examples of a touchless beverage dispensing valve assembly, the optical sensor is a first optical sensor and the trigger sensor includes a second optical sensor. The first optical sensor is arranged to project light energization at a region below the nozzle and the second optical sensor is arranged to project light energization at a region forward of the nozzle. The output from the first optical sensor is a first output and the controller is configured to receive a second output from the second optical sensor. The controller is configured to interpret a deviation in the first output from a first baseline output of the first optical sensor as a presence of a receptacle below the nozzle. The controller is configured to interpret a deviation in the second output from a second baseline output as a user gesture. The controller is configured to operate the feedback device to provide the visual indication of the active dispensing operation and to operate the solenoid to operate the valve in the open condition upon concurrent detection of the presence of the receptacle below the nozzle and the user gesture. The substance may be a beverage or ice.

An example of a method of dispensing a beverage using a touchless beverage dispensing valve assembly includes receiving, with the controller, a current output from the optical sensor. The current output is determined as a baseline output. A deviation from the baseline output is detected in the current output. The feedback device is operated to visually present an indication of the detected receptacle. A deviation from the baseline output of a predetermined magnitude and a predetermined duration is detected. The feedback device is operated to visually present an indication of the active dispensing operation. The solenoid is operated to operate the valve to the open condition. An elapsed time that the valve is in the open condition is measured. The feedback device is operated to provide a visual indication of the elapsed time. The solenoid is operated to operate the valve to the closed condition upon either a detected change in the current output of the optical sensor towards the baseline output or the elapsed time reaching a predetermined time.

BRIEF DESCRIPTION OF THE DRAWINGS

The present disclosure includes the following Figures. The same numbers are used throughout the Figures to reference like features and like components.

DETAILED DISCLOSURE

In the present description, certain terms have been used for brevity, clearness, and understanding. No unnecessary limitations are to be inferred therefrom beyond the requirement of the prior art because such terms are used for descriptive purposes only and are intended to be broadly construed.

The present disclosure generally relates to ice and beverage dispensing systems with improved sanitary features. Beverage dispensers are commonly used in restaurants and convenience stores to mix a beverage concentrate with carbonated or non-carbonated water and to cool the mixed beverage. Due to their ease of use, many ice and beverage dispensing systems are located in restaurant dining rooms or on convenience store sales floors to permit customers to select and dispense their own beverages. Permitting unfettered customer access to ice and beverage dispensing systems can increase customer satisfaction and decrease restaurant labor costs. However, this access can also increase the spread of pathogens due to the number of customers touching the beverage dispenser valves. The present inventors have recognized that customer comfort and safety would be increased through the use of an ice and beverage dispenser with beverage valve assemblies that do not require customer contact for operation.

Figure 1:
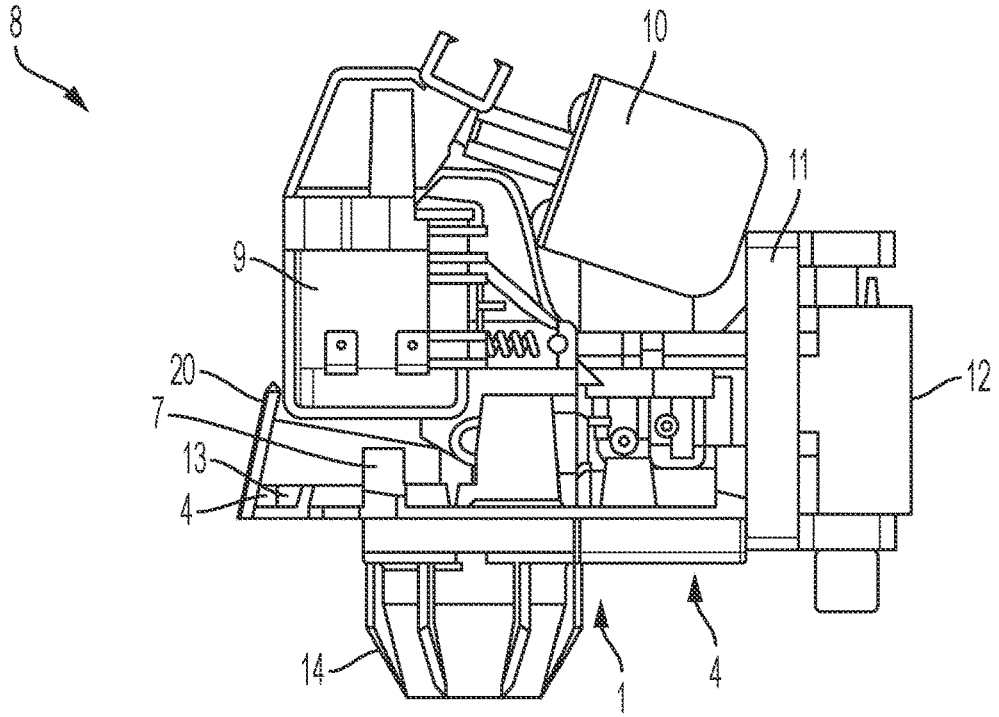
FIG. 1 is a side cross-sectional view of a touchless beverage valve assembly.
Figure 1:
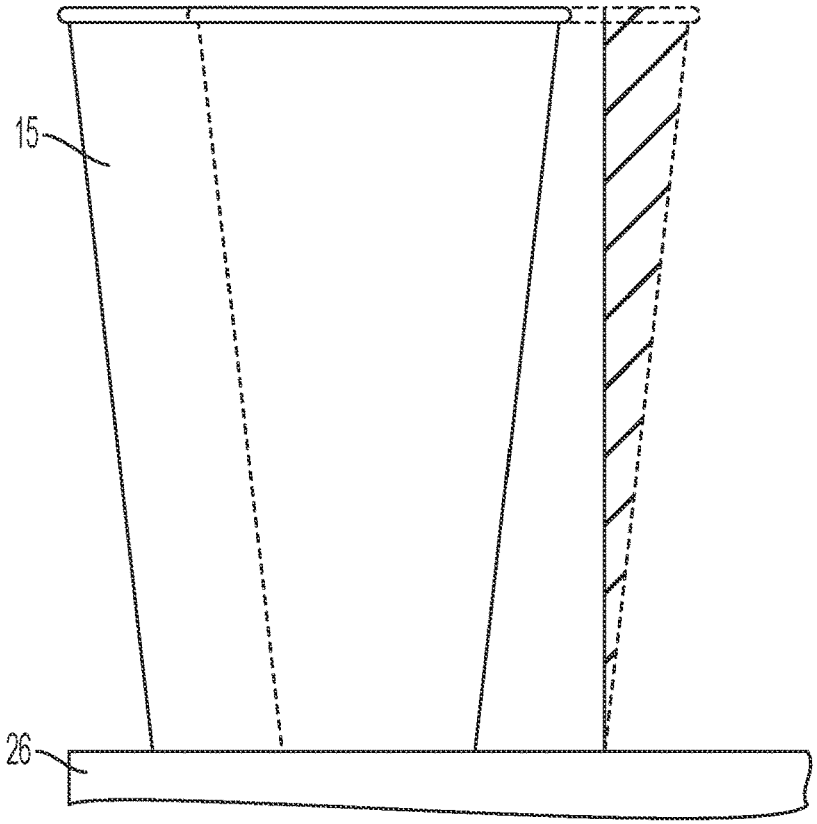
Figure 2:
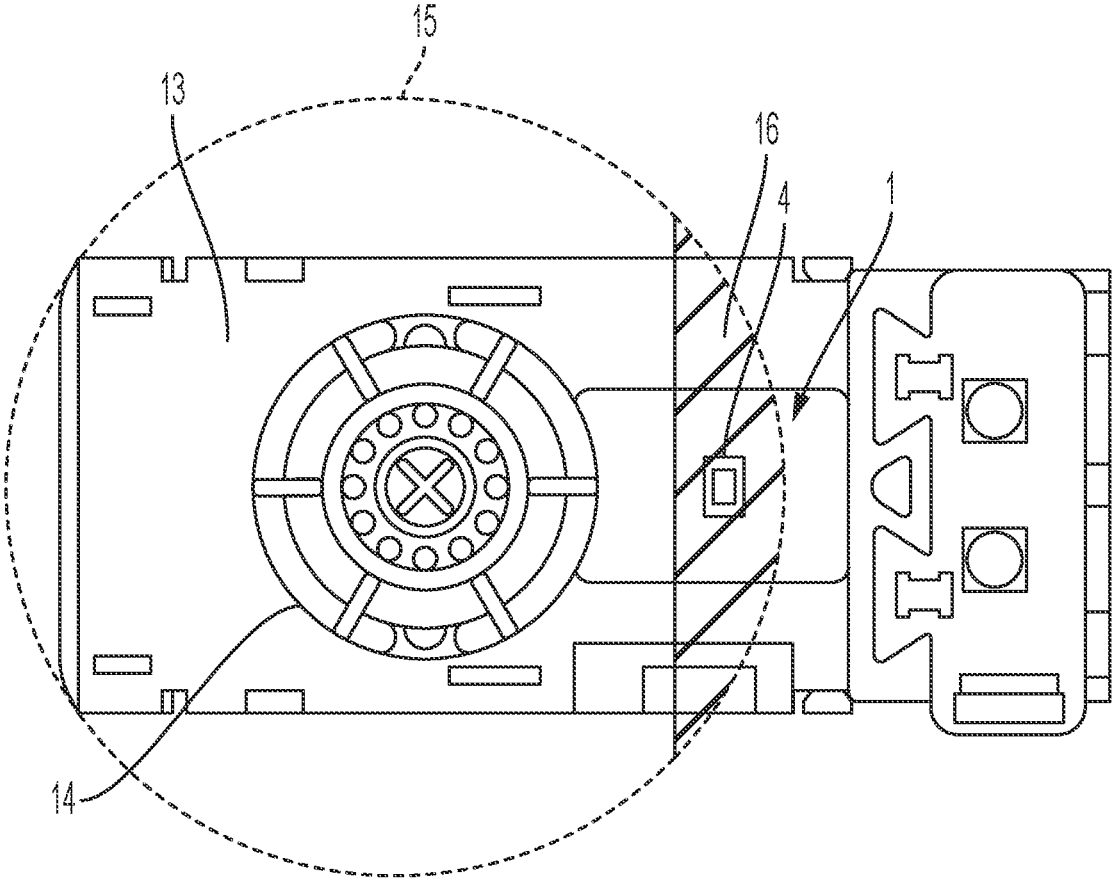
FIG. 2 is a bottom view of the touchless beverage valve assembly of FIG. 1.

FIG. 1 depicts an example of a touchless beverage valve assembly 8, as shown and described in detail herein. Examples of the touchless beverage valve assembly 8 can provide improved sanitation in operation and use. The touchless beverage valve assembly 8 is shown to include, among other components a trigger sensor 1. The trigger sensor 1 can include various components and implementations as described herein all of which are considered to be variations of the disclosed trigger sensor. The touchless beverage valve assembly 8 further includes a nozzle 14 coupled to the underside of a valve base plate 13. A solenoid 9 is operatively connected to a valve 10. The valve 10 is connected to a valve mounting block 11 and a back block 12 to a source of the substance to be dispensed. The solenoid 9 operates to actuate the valve 10 between an open condition that permits the flow of a substance through the valve 10 and a closed condition that occludes flow of the substance through the valve 10. It will be recognized that while the present disclosure uses the example of a liquid, which may exemplarily include water, carbonated water, a pre-mixed beverage, or a post-mixed beverage, in other examples, the substance may be ice, and the arrangement and configuration of components for ice dispensing will be recognized based upon the disclosure provided herein, as well as the references noted above, the contents of which have incorporated by reference.

Above the valve base plate 13, the valve assembly 8 includes a controller 7, which is exemplarily a single board computer (SBC) or a central processing unit (CPU), that includes a processor. The processor of controller 7 may be integral with or communicatively connected to a computer-readable medium upon which computer-readable code is stored. Upon execution of the computer-readable code by the processor, the processor performs functions and calculations and subsequently transmits control signals as described herein. The controller 7, is communicably coupled to the trigger sensor 1, the valve solenoid 9, and a feedback device 20. As described herein, the controller operates to coordinate the detection of a receptacle and/or user input with the trigger sensor 1, with the operation of the valve solenoid 9 to dispense a substance and control the feedback device 20 to communicate an operational status of the dispenser to a user.

In examples, the touchless beverage valve assembly 8 operates to dispense a beverage into a receptacle based upon a touchless interaction with the touchless beverage valve assembly 8. The trigger sensor 1 includes one or more optical sensors as described in further detail herein which register the touchless interaction for subsequent interpretation by the controller 7. In an example, the trigger sensor 1 detects the presence of the receptacle, which may be a cup 15, beneath the nozzle 14. In an exemplary implementation, at least one optical sensor 4 of the trigger sensor 1 is positioned such that the at least one optical sensor 4 detects a cup target zone 16 that is below the trigger sensor 1 and in the region of the rear lip of the cup 15 (depicted as the shaded regions).

Figure 3:
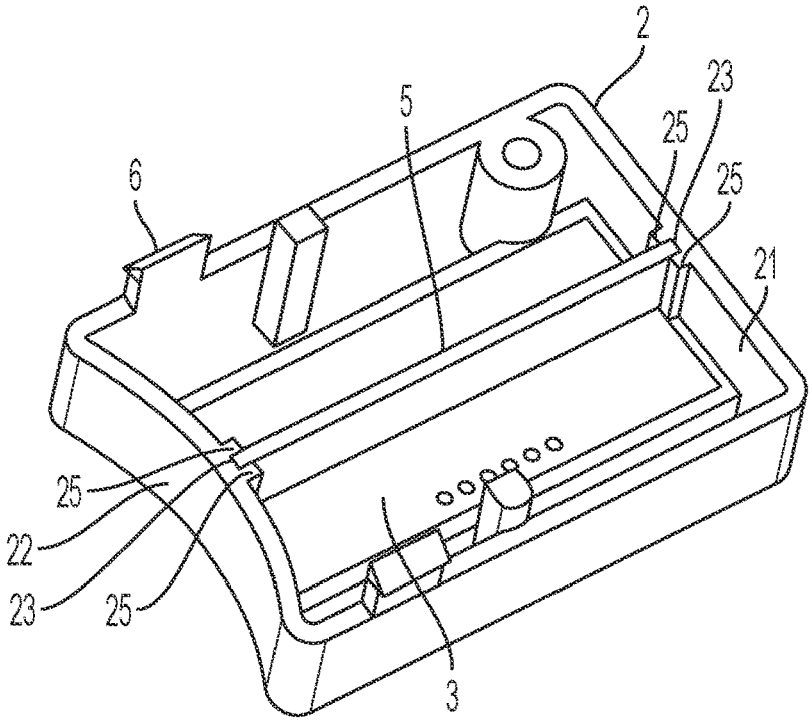
FIG. 3 is a top perspective view of an isolated portion of the trigger sensor used in the touchless beverage valve assembly of FIG. 1.
Figure 4:
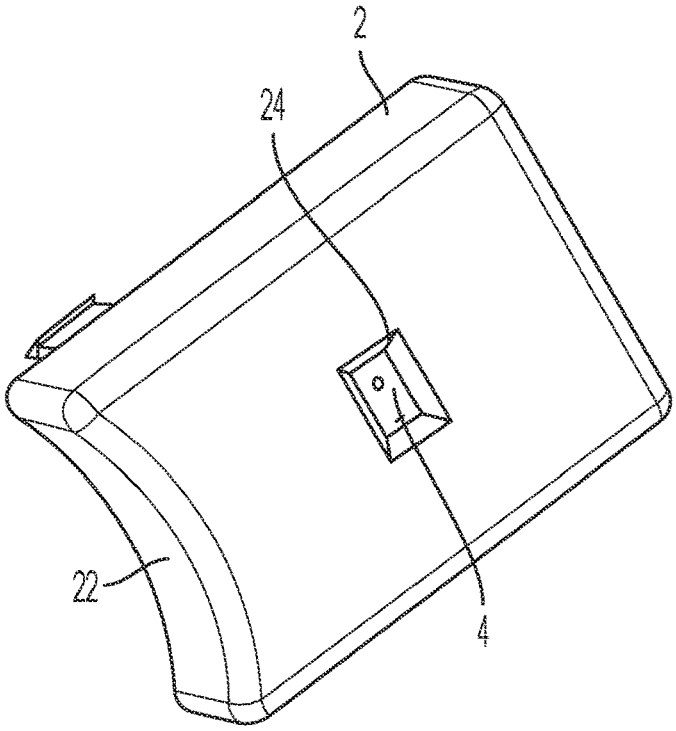
FIG. 4 is a bottom perspective of the isolated portion of the trigger sensor of FIG. 4.

FIGS. 3 and 4 provide perspective views of an example of the trigger sensor 1 utilized in the touchless beverage valve assembly 8 are depicted. The trigger sensor 1 includes a trigger sensor controller 3, which may be in the form of a printed circuit (PC) board located within a trigger sensor housing 2. The trigger sensor housing 2 further includes a retainer bar 5 that secures between interior surfaces 21 of the walls of the trigger sensor housing 2. In an example, the interior surfaces 21 of the walls include a recess 23 that is defined by either or both of a cut out into the interior surfaces 21 of the walls and/or ribs 25 defining the recess 23. The retainer bar 5 secures within the recesses 23 to brace the trigger sensor controller 3 within the housing 2 and ensure that the optical sensor 4 is correctly positioned within the housing 2. The housing 2 is further includes retainer clips 6 that extend upwardly from the sidewalls of the housing 2. To secure the trigger sensor housing 2 to the valve base plate 13 as described in further detail herein. The trigger sensor housing 2 exemplarily includes a curved wall 22 that is configured to match a corresponding curve of the nozzle 14 such that the trigger sensor housing 2 can be mounted flush against the nozzle 14. In this way, the trigger sensor 1 does not interfere with or increase the difficulty in completing required cleaning procedures for the nozzle 14, and may be configured for implementation as a retro-fit addition to an existing beverage valve assembly.

An optical sensor 4 is mounted to the trigger sensor controller 3 and positioned within a cutout region 24 of the housing 2. The trigger sensor controller 3 may be considered to be a component of the optical sensor 4 or in other implementations may be a separate component connected to the optical sensor 4. The optical sensor 4 may be any of a variety of photoelectric sensors. Examples of the optical sensor 4 may include a through-beam sensor, a reflective through-beam, a reflective laser, or a diffuse photoelectric sensor. Optical sensors may operate within visible or infrared (IR) light frequency bands. Signals from the at least one optical sensor may be analyzed by the trigger sensor controller 3 in proximity sensing or range sensing implementations. The trigger sensor controller 3 provides this output of the optical sensor 4 to the controller 7. In an exemplary implementation, the trigger sensor 1 is implemented in part by a VL6180 proximity sensing module manufactured by STMicroelectronics that includes both an infrared emitter and a range sensor. The infrared emitter and the range sensor act as a time-of-flight sensor by calculating range measurements based on the time it takes light emitted from the infrared emitter to travel to the nearest object and reflect back to the range sensor. In this way, distance measurements are obtained independent of the reflectance of the target object, meaning that the optical sensor 4 is operable in the presence of both clear and transparent cups, as well as cups filled with ice. In other implementations, a different style of distance sensor (e.g., laser, lidar, radar, ultrasonic) may be utilized. In some implementations, these sensing technologies may be utilized to confirm the presence of ice in a cup and/or to determine the fill height of liquid in a cup.

The cutout region 24 may include a protective material such as polycarbonate that is coated with a hydrophobic coating to prevent fluid build-up such as water, carbonated water, and syrup. The optical sensor 4 is configured to detect the distance to or the presence of an object below the sensor. Under a standby condition, that is, during the absence of a cup below the nozzle 14, the optical sensor 4 may detect a structural component of the ice and beverage dispenser itself. For example, a drip tray 26 may be positioned 10 inches below the touchless beverage valve assembly 8 to catch any beverage overflow from a dispensing operation. Thus, the nominal distance measurement detected by the optical sensor 4 may be 10 inches. When a user places a cup below the nozzle 14, the distance detected by the optical sensor 4 is reduced. For example, the optical sensor 4 may detect a distance measurement from the lip of the cup of 2 inches or less. If the distance measurement detected by the optical sensor 4 is less than a predetermined threshold indicative of a receptacle (e.g. 4 inches or the distance to the lip of a smallest expected sized receptacle).

Figure 5:
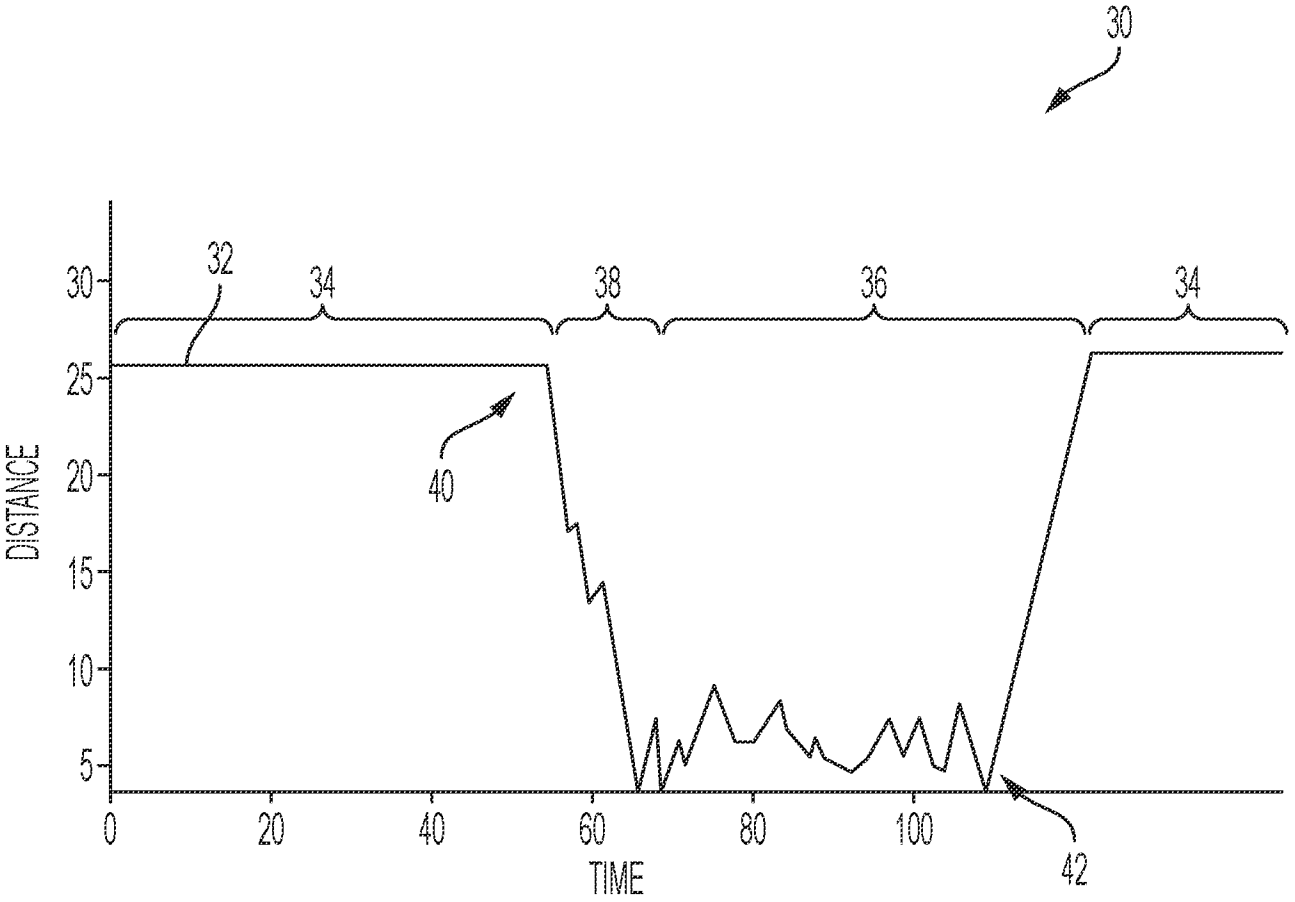
FIG. 5 is a graph illustrating an example of the sensor output data during a dispense cycle and associated with various operating conditions of the touchless beverage valve assembly.

FIG. 5 is a graph 30 that presents an example of an output signal 32 provided by the optical sensor/controller 3 to the controller 7. The output signal 32 is exemplarily an indication of measured distance (but may also be an indication of detected proximity) over time. Initially, the graph 30 presents the standby condition 34 in which the nominal distance, e.g. 26 cm is measured. At reference point 40, a user exemplarily introduces a cup below the nozzle. Initially, the signal is transitory as the user is moving the cup into position, as described in further detail below, this may be interpreted by the controller 7 as a detection condition 38, but the controller 7 may remain in this condition until the output signal 32 persists for a predetermined time (e.g. 100 ms or 200 ms or another predetermined time period) and/or the output signal 32 stabilizes, indicative of the cup resting in a position to be filled. Upon this determination, the controller 7 may operate to an active dispensing condition 36 whereby the solenoid 9 is operated to actuate the valve 10 from the closed condition into the open condition, and beverage is dispensed through the valve 10 into and through the nozzle 14 into the cup 15. As described in further detail herein, the solenoid 9 may be operated to hold the valve 10 in the open condition until either of a predetermined time has elapsed or the cup is removed from the target area, for example as provided by reference point 42. Thereafter, the controller 7 operates the solenoid 9 to actuate the valve 10 from the open condition to the closed condition and remain in a standby condition 34.

The controller 7 is configured to receive a signal from the optical sensor 4/controller 3 of the optical sensor 4 indicative of objects positioned within the target area of the optical sensor 4. In response, the controller 7 provides control signals to one or both of the feedback device 20 and the solenoid 9, as described in further detail herein. Controller 7 may be configured to transmit a signal to operate the valve solenoid 9 and open the flow of beverage through the nozzle 14. The trigger sensor 1 of the present invention allows for a touchless design that can be used in parallel to the lever or push button in the example of a retrofit to an existing beverage dispenser or standalone without a lever or push button.

Figure 6:
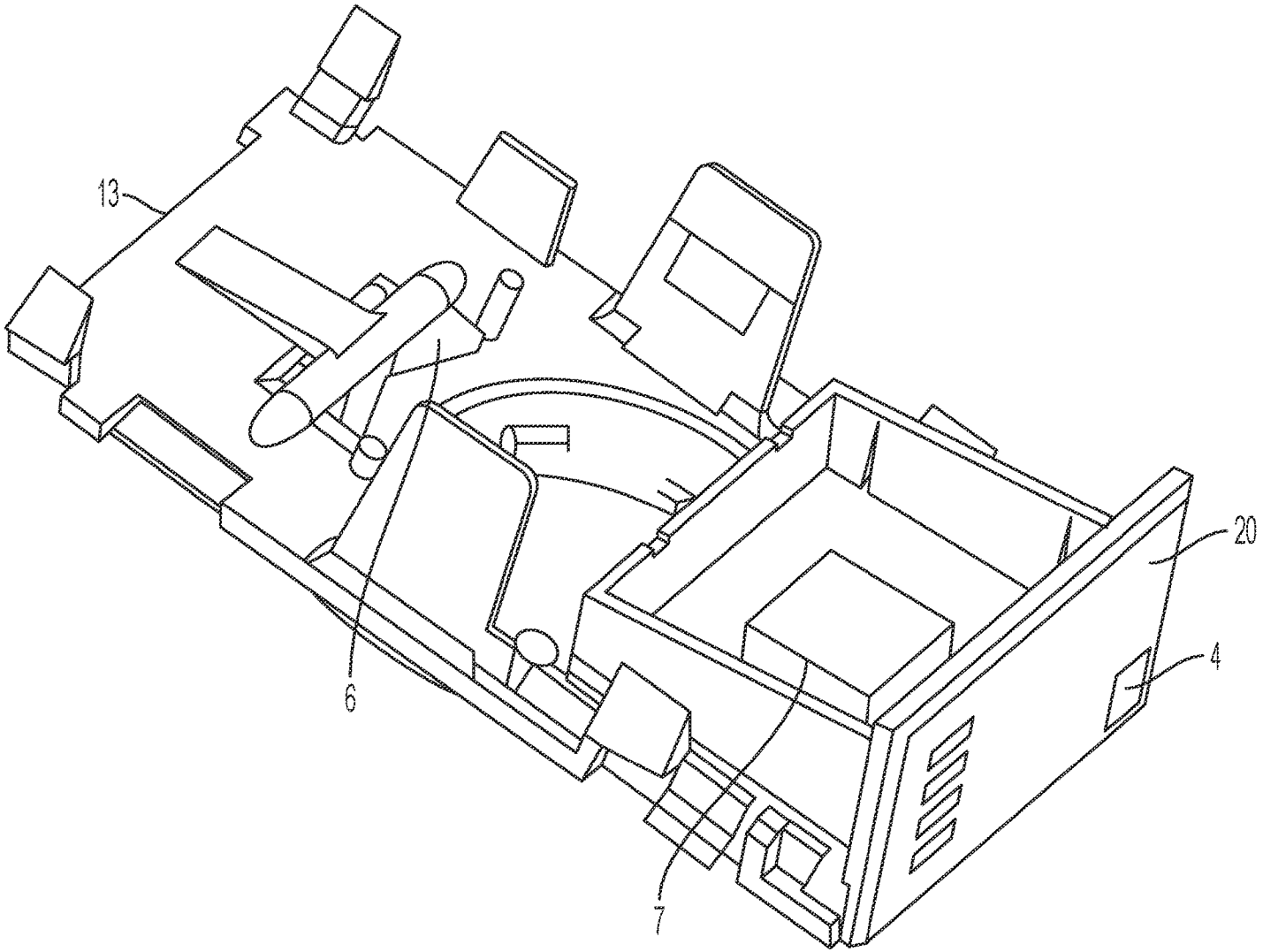
FIG. 6 is an isolated perspective view of a valve base plate used in the touchless beverage valve assembly of FIG. 1.

FIG. 6 is a top perspective view of the valve base plate 13 and components attached thereto. Retainer clips 6 from the trigger sensor housing 2 are visible through the valve base plate 13. The retainer clips 6 are exemplarily resiliently deformable to engage and secure with the valve base plate 13. Because the trigger sensor 1 fits within the existing footprint of the valve base plate 13, the touchless activation feature is easily retrofittable on existing valve assemblies. In another exemplary implementation, the trigger sensor housing 2 and the valve base plate 13 are injection molded as a single inseparable part. Fewer separable parts result in a valve assembly that is easier to clean and maintain. At the same time, existing valve assemblies are retrofittable through the replacement of the combined valve base plate and trigger sensor module housing. The valve base plate 13 further houses the controller 7. The feedback device 20, which may be a series of light-emitting diodes (LEDs) or other illuminative visual display is further supported by the valve base plate 13. An additional optical sensor 4, as will be described herein may further be supported by the valve base plate 13.

Figure 7:
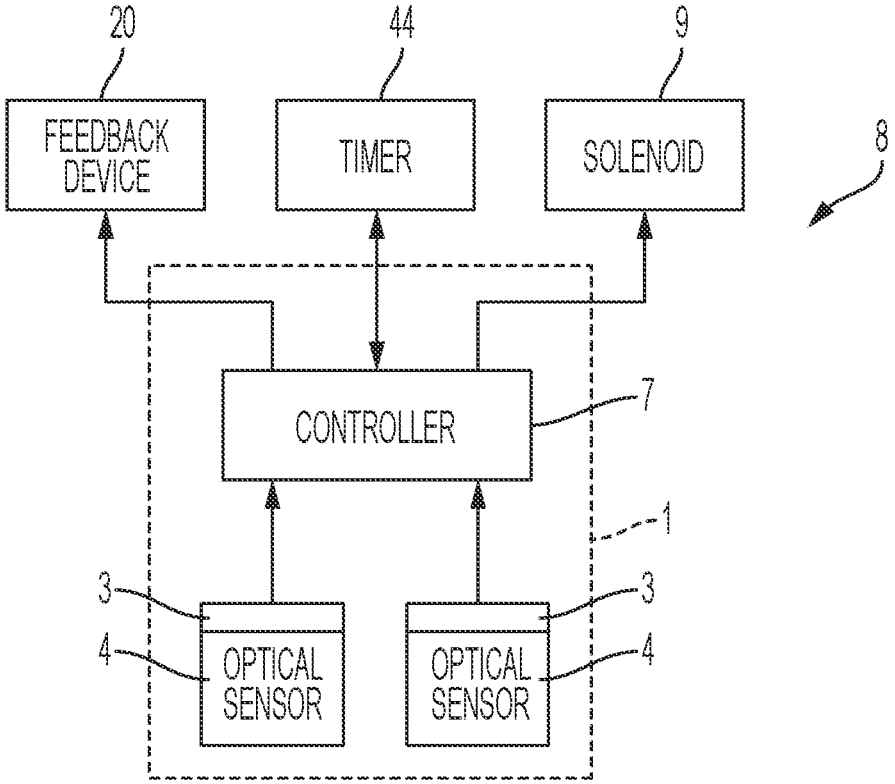
FIG. 7 is a schematic system diagram of the touchless beverage valve assembly.

FIG. 7 is a system diagram of an example of the trigger sensor 1 as described herein, FIG. 7 includes various components as previously shown and described, presenting them in a schematic representation to provide a further description of the communicative connections between the components. FIG. 7 thus depicts the trigger sensor 1, including at least one, and in examples more than one, optical sensor 4, the optical sensors 4 including optical sensor controllers 3 which facilitate the production of optical sensor output. The controller 7 receives the optical sensor outputs and processes the same to determine a status of the touchless beverage valve assembly 8. As described with respect to FIG. 5, the controller 7 may determine a standby status from a baseline output signal. The controller 7 may operate the feedback device 20 to produce an indication of the standby status and/or an instruction for a user to operate the touchless beverage valve assembly 8. Upon detecting a deviation in the received output signal, the controller 7 determines a cup detection status and may provide a control signal to the feedback device 20 to indicate that a cup is detected, but that dispensing has not been initiated. If the controller 7 identifies a deviation in the baseline output signal of at least a predetermined amount and for at least a predetermined duration, then the controller 7 produces a control signal to the solenoid 9, which receives the control signal and actuates the valve 10 to the open condition. The controller 7 also provides a control signal to the feedback device 20 to provide an indication that the touchless beverage valve assembly 8 is actively dispensing. If the output signal received by the controller 7 returns towards the baseline output, the controller 7 produces a control signal to the solenoid 9, upon which the solenoid 9 actuates the valve 10 to the closed position. In an example, the controller 7 is further connected to or includes a timer 44, the timer 44 operates to measure an elapsed time that the touchless beverage valve assembly 8 has been in the active dispensing condition. The controller 7 may measure the elapsed time until a maximum dispense time is reached and then produce the control signal to the solenoid 9, upon which the solenoid 9 actuates the valve 10 to the closed position. The controller 7 may further produce a control signal to the feedback device 20 to operate the feedback device 20 to produce an indication of the elapsed time. In an example, feedback device 20 is operated to illuminate LEDs to provide an indication of the progression of the elapsed time to a maximum dispense time. Such progression may be represented by illumination of a series of LEDs.

Figure 8:
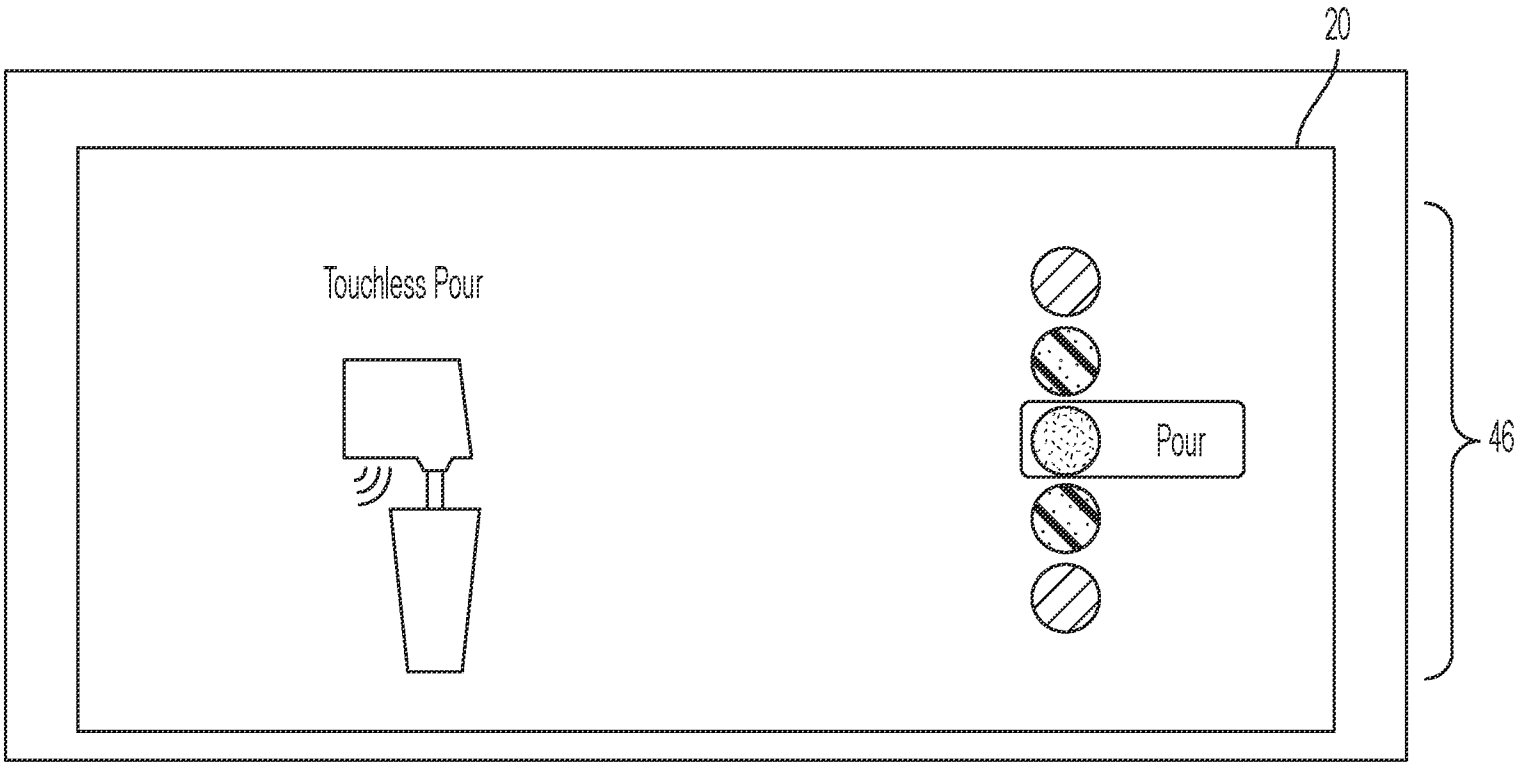
FIG. 8 is a front view of an example of a feedback device.

FIG. 8 provides an example of a feedback device 20, which may be in the form of a graphical display or a plurality of LEDs 46 as depicted in FIG. 8 which are configured to indicate the status of the valve in a beverage filling operation. The multiple status indicator LEDs may provide feedback to the user regarding the position of the cup and the status of a beverage filling operation. For example, the LEDs 46 may illuminate in succession as the cup 15 is correctly positioned beneath the nozzle 14. When the cup 15 is positioned within the target region of the optical sensor 4, all of the LEDs 46 may flash or otherwise animate to indicate imminent beverage dispensing. The LEDs 46 may remain illuminated until the cup 15 is removed from beneath the nozzle 14. If the dispensing continues for an extended period of time, the LEDs 46 may be turned off one-by-one to indicate an approaching timeout where dispensing will terminate. The timeout prevents the valve assembly 8 from continuous dispensing due to malicious behavior such as fixing a physical object to the target zone.

Figure 9:
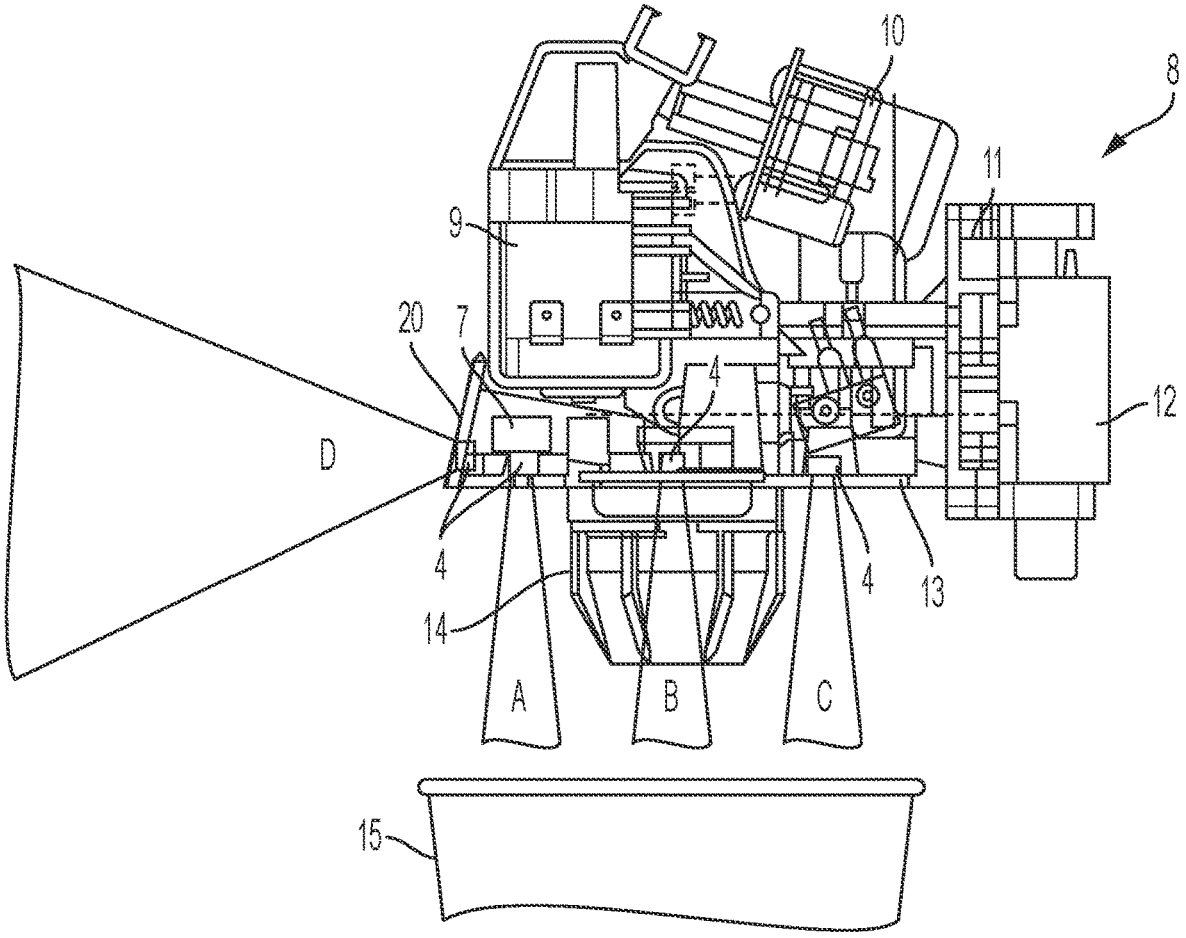
FIG. 9 is a side cross-sectional view of a touchless beverage valve assembly with additional sensor locations.

FIG. 9 depicts additional trigger sensor configurations for a beverage valve assembly 8 are depicted. FIG. 9 depicts a touchless beverage valve assembly 8 with multiple optical sensors 4 at locations A, B, C, and D. As previously noted, the touchless beverage valve assembly 8 includes at least one optical sensor 4. Optical sensors 4 may be positioned at one or more of the locations A, B, C, and D. Each of the optical sensors 4 at locations A, B, C may be vertically oriented to detect a cup 15 positioned beneath the sensors A, B, and C. The use of multiple sensors 4 may reduce the risk of accidental initiation of an active dispensing operational status. In addition to the use of multiple sensors 4, alternative non-vertical orientations for one or more the sensors 4 may be utilized. For example, trigger sensor A may be positioned at an angle towards the back of the dispenser to detect a rear portion of the cup 15, and trigger sensor C may be positioned at an angle towards the front of the dispenser to detect a front portion of the cup 15. In still further implementations, the trigger sensors may be configured to detect a fill level of beverage within a cup 15 in addition to detection of the presence of the cup 15. Additionally, the sensor 4 at location D is directed outwards away from the touchless beverage valve assembly 8 to detect gesture or user movement inputs.

Figure 10:
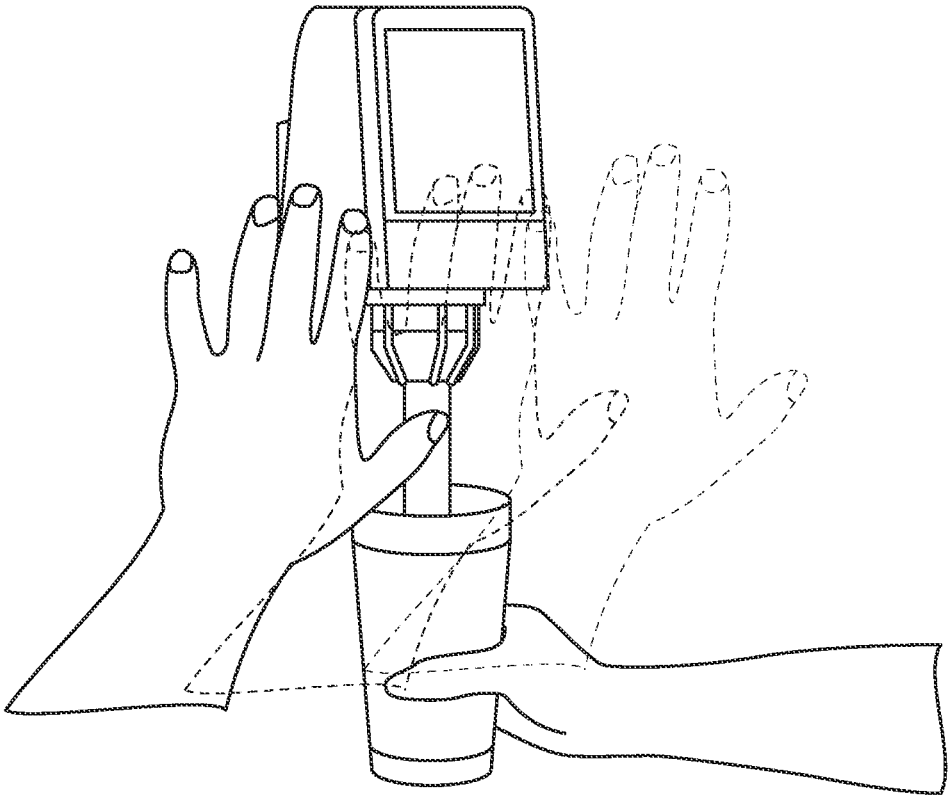
FIG. 10 is a perspective view illustrating an operation of a motion or gesture user input.

FIG. 10 depicts a touchless beverage valve assembly 8 with a triggering system that uses inputs from at least two optical sensors 4. At least one optical sensor output comes from an optical sensor directed outwards from the touchless beverage valve assembly 8. In combination with the detection of a cup as described above, the controller 7 further requires an input of a detected gesture or movement by an additional optical sensor 4. For example, the sensor 4 is configured to detect the presence and/or motion of a user's hand. The feedback device 20 may visually present an instruction to a user, notifying them of the motion activation feature. In an exemplary implementation, feedback device 20 may include a series of status indicator LEDs including or in addition to the LEDs described previously. The LEDs are illuminated based on whether the user's hand is within the target range of the trigger sensor, too close to the trigger sensor, or too far away. For example, a central green LED may illuminate when the user's hand is within the target range, and yellow or red LEDs positioned above and below the central green LED may illuminate based on whether the user's hand is too close or too far away from the target range. Similar to the LED operation described above, all LEDs may flash to indicate imminent beverage dispensing, and all LEDs may turn off when the user removes his or her hand from the vicinity of the trigger sensor control module.

Citations to a number of references are made herein. The cited references are incorporated by reference herein in their entireties. If there is any inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims

We claim:

1. A touchless beverage dispensing valve assembly, comprising:

a nozzle;

a valve coupled upstream of the nozzle, the valve configured to control a flow of a substance through the valve to the nozzle;

a solenoid operatively connected to the valve and configured to operate the valve between an open condition and a closed condition;

a trigger sensor comprising an optical sensor;

a feedback device configured to selectively provide visual indications; and a controller configured to execute a trigger sensor control module to receive a current output from the optical sensor and operate the solenoid to control the valve from a closed condition to an open condition to dispense the substance through the nozzle when a deviation from a baseline value of the current output from the optical sensor exceeds a predetermined amount for a predetermined duration;

wherein the controller is configured to operate the feedback device to present a first visual indication representative of a stand-by condition in response to the baseline value in the current output from the optical sensor, to operate the feedback device to present a second visual indication representative of detection of a receptacle in response to the deviation from the baseline value in the current output from the optical sensor, and to operate the feedback device to present a third visual indication representative of an active dispensing operation in response to the deviation from the baseline value in the output from the current optical sensor exceeding the predetermined amount and for the predetermined duration.

2. The valve assembly of claim 1, wherein the optical sensor is a photoelectric sensor.

3. The valve assembly of claim 1, wherein the controller is configured to operate the feedback device to provide the visual indication of the active dispensing operation when the current output of the optical sensor deviates from the baseline output signal by a predetermined amount for at least 100 ms.

4. The valve assembly of claim 3, wherein the controller is configured to operate the solenoid to operate the valve to the open condition after the feedback device is operated to provide the third visual indication representative of the active dispensing operation.

5. The valve assembly of claim 4, wherein the controller is configured to measure an elapsed time that the valve is in the open condition and the controller is further configured to operate the feedback device to provide a visual indication of the elapsed time.

6. The valve assembly of claim 5, wherein the controller is configured to operate the solenoid to operate the valve to the closed condition upon either of a detected change in the current output of the optical sensor towards the baseline output signal or the elapsed time reaching a predetermined time.

7. The valve assembly of claim 1, wherein the controller is configured to receive and store a value representative of the baseline output signal through a calibration process.

8. The valve assembly of claim 1, further comprising a trigger sensor housing surrounding the optical sensor and an optical sensor circuit board, wherein the optical sensor circuit board is communicatively connected to the optical sensor and produces the output.

9. The valve assembly of claim 8, further comprising:

a base plate configured to be positioned about the nozzle and configured to retain the controller and the feedback device;

wherein the trigger sensor housing further comprises a plurality of retainer clips configured for resilient deformation to retain the trigger sensor housing to the base plate at a position with the trigger sensor housing in contact with the nozzle and vertically above a lowermost portion of the nozzle.

10. The valve assembly of claim 9, wherein the trigger sensor housing comprises a retainer bar that secures within retainer recesses on interior faces of walls of the trigger sensor housing and the retainer bar is configured to secure the optical sensor and the optical sensor circuit board within the trigger sensor housing.

11. The valve assembly of claim 1, further comprising a trigger sensor housing comprising a curved exterior wall configured to mount flush with a corresponding curved portion of the nozzle.

12. The valve assembly of claim 1, wherein the optical sensor is a first optical sensor and the trigger sensor comprises a second optical sensor, wherein the first optical sensor is arranged to project light energization at a region below the nozzle and the second optical sensor is arranged to project light energization at a region forward of the nozzle, wherein the output from the first optical sensor is a first output and the controller is configured to receive a second output from the second optical sensor.

13. The valve assembly of claim 12, wherein the controller is configured to interpret a deviation in the first output from a first baseline output of the first optical sensor as a presence of a receptacle below the nozzle and the controller is configured to interpret a deviation in the second output from a second baseline output as a user gesture, wherein the controller is configured to operate the feedback device to provide the visual indication of the active dispensing operation and to operate the solenoid to operate the valve in the open condition upon concurrent detection of the presence of the receptacle below the nozzle and the user gesture.

14. The valve assembly of claim 1, wherein the substance is a beverage.

15. The valve assembly of claim 1, wherein the substance is ice.

16. A method of dispensing a beverage using the valve assembly of claim 1, the method comprising:

receiving, with the controller, the current output from the optical sensor;

determining that the current output is the baseline value;

operating the feedback device to present the first visual indication representative of the stand-by condition in response to the baseline value;

subsequently detecting a deviation from the baseline value in the current output;

in response to detecting the deviation, operating the feedback device to visually present the second visual indication representative of detection of a receptacle by the optical sensor;

further determining that the deviation from the baseline value exceeds a predetermined magnitude for a predetermined duration;

subsequently, operating the feedback device to visually present the third visual indication representative of the active dispensing operation; and operating the solenoid to operate the valve to the open condition.

17. The method of claim 16, further comprising:

measuring an elapsed time that the valve is in the open condition;

operating the feedback device to provide a fourth visual indication representative of the elapsed time; and operating the solenoid to operate the valve to the closed condition upon either of a detected change in the current output of the optical sensor towards the baseline output or the elapsed time reaching a predetermined time.

* * * * *